US010415337B2

(12) United States Patent
Michael et al.

(10) Patent No.: US 10,415,337 B2
(45) Date of Patent: Sep. 17, 2019

(54) CORE CATCHER FOR UNCONSOLIDATED SEDIMENT SAMPLES

(71) Applicant: Saudi Arabian Oil Company, Dhahran (SA)

(72) Inventors: Nikolaos A. Michael, Abqaiq (SA); Peng Lu, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 128 days.

(21) Appl. No.: 15/867,912

(22) Filed: Jan. 11, 2018

(65) Prior Publication Data

US 2019/0211639 A1 Jul. 11, 2019

(51) Int. Cl.
*E21B 25/10* (2006.01)

(52) U.S. Cl.
CPC ..... *E21B 25/10* (2013.01)

(58) Field of Classification Search
CPC ..... E21B 25/00; E21B 25/10
See application file for complete search history.

(56) References Cited

U.S. PATENT DOCUMENTS

| | | | |
|---|---|---|---|
| 1,373,492 | A | 4/1921 | Dodds |
| 1,775,920 | A | 9/1930 | Wellensiek |
| 1,784,886 | A | 12/1930 | Baker |
| 1,808,009 | A | 6/1931 | Scott |
| 1,987,853 | A | 1/1935 | Howard et al. |
| 1,995,337 | A | 3/1935 | Wright |
| 2,076,837 | A | 4/1937 | Grimmelsman |
| 2,083,062 | A | 6/1937 | Hampton |
| 2,103,611 | A | 12/1937 | Catland |
| 2,141,261 | A | 12/1938 | Clark |
| 2,161,582 | A | 6/1939 | MacKenzie et al. |
| 2,170,716 | A | 8/1939 | Higgins, Jr. |
| 2,221,392 | A | 11/1940 | Baker |
| 2,382,992 | A | 8/1945 | Harris |
| 2,471,616 | A | 5/1949 | MacKenzie et al. |
| 2,698,737 | A | 1/1955 | Dean |
| 2,740,477 | A | 4/1956 | Monaghan |
| 3,064,742 | A | 11/1962 | Bridwell |
| 3,066,748 | A | 12/1962 | Doherty |

(Continued)

OTHER PUBLICATIONS

International Search Report and Written Opinion for International PCT application PCT/US2019/012240 dated Apr. 11, 2019; pp. 1-12.

*Primary Examiner* — Kristyn A Hall
(74) *Attorney, Agent, or Firm* — Bracewell LLP; Constance G. Rhebergen; Vivek P. Shankam

(57) ABSTRACT

A core sampler including an inner wall, an outer wall, a plurality of membranes disposed between the inner wall and outer wall, the plurality of membranes attached to the inner wall and outer wall at one or more attachment points, and a rotating knob attached to the inner wall or outer wall, the rotating knob configured to rotate the inner wall relative to the outer wall when the rotating knob is attached to the inner wall and to rotate the outer wall relative to the inner wall when the rotating knob is attached to the outer wall, wherein the membranes reside between the inner wall and the outer wall when the core sampler is fully open, and wherein the membranes come together and fully close the core sampler when the rotating knob is rotated 180 degrees or more.

20 Claims, 7 Drawing Sheets

(56) References Cited

U.S. PATENT DOCUMENTS

| | | | | |
|---|---|---|---|---|
| 3,139,147 | A | | 6/1964 | Hays et al. |
| 3,146,837 | A | | 9/1964 | Bridwell |
| 3,163,241 | A | | 12/1964 | Daigle et al. |
| 3,298,450 | A | | 1/1967 | Sato |
| 3,372,760 | A | | 3/1968 | Raymond et al. |
| 3,383,131 | A | | 5/1968 | Rosfelder |
| 3,438,452 | A | | 4/1969 | Bernard et al. |
| 3,497,018 | A | | 2/1970 | Shultz et al. |
| 3,794,127 | A | | 2/1974 | Davis |
| 3,807,234 | A | | 4/1974 | Duperon |
| 3,833,075 | A | | 9/1974 | Bachman et al. |
| 3,874,465 | A | | 4/1975 | Young et al. |
| 3,878,904 | A | | 4/1975 | Dobson |
| 3,952,817 | A | * | 4/1976 | Anderson ..... E21B 25/10 175/240 |
| 4,081,040 | A | | 3/1978 | Henson |
| 4,142,594 | A | | 3/1979 | Thompson et al. |
| 4,234,046 | A | | 11/1980 | Haynes |
| 4,310,057 | A | | 1/1982 | Brame |
| 4,317,490 | A | | 3/1982 | Milberger et al. |
| 4,335,622 | A | | 6/1982 | Bartz |
| 4,350,051 | A | | 9/1982 | Thompson |
| 4,356,872 | A | | 11/1982 | Hyland |
| 4,518,050 | A | | 5/1985 | Sollie et al. |
| 4,552,229 | A | | 11/1985 | Radford et al. |
| 4,605,075 | A | | 8/1986 | Radford et al. |
| 4,606,416 | A | | 8/1986 | Knighton et al. |
| 4,607,710 | A | | 8/1986 | Radford |
| 4,651,835 | A | | 3/1987 | Davis |
| 4,669,554 | A | | 6/1987 | Cordry |
| 4,804,050 | A | | 2/1989 | Kerfoot |
| 4,807,707 | A | | 2/1989 | Handley et al. |
| 4,930,587 | A | | 6/1990 | Young et al. |
| 4,946,000 | A | | 8/1990 | Gibson et al. |
| 5,101,917 | A | | 4/1992 | Abdul et al. |
| 5,253,720 | A | | 10/1993 | Radford et al. |
| 5,419,211 | A | | 5/1995 | Rodel et al. |
| 5,644,091 | A | | 7/1997 | Jacq et al. |
| 5,771,985 | A | | 6/1998 | Jaworski |
| 6,009,960 | A | | 1/2000 | Leitko, Jr. et al. |
| 6,659,204 | B2 | | 12/2003 | Aumann et al. |
| 7,021,604 | B1 | | 4/2006 | Werner et al. |
| 8,109,347 | B2 | | 2/2012 | Jhin et al. |
| 8,429,988 | B2 | | 4/2013 | Schnupp et al. |
| 9,322,265 | B2 | | 4/2016 | Kong |
| 9,502,141 | B2 | | 11/2016 | Rosen et al. |
| 9,506,307 | B2 | | 11/2016 | Kinsella |
| 2003/0089526 | A1 | | 5/2003 | Beeker |
| 2003/0205408 | A1 | | 11/2003 | Lee et al. |
| 2005/0133267 | A1 | | 6/2005 | Reid, Jr. et al. |
| 2012/0261192 | A1 | | 10/2012 | Mageren |
| 2015/0255179 | A1 | | 9/2015 | Rosen et al. |

* cited by examiner

CORE CATCHER FOR UNCONSOLIDATED SEDIMENT SAMPLES

TECHNICAL FIELD

Example embodiments generally relate to coring sediments from the earth, and more specifically relate to an apparatus and method for micro-coring unconsolidated sediments from the earth.

BACKGROUND

Wells are generally drilled into the ground to recover natural deposits of oil and gas, as well as other desirable materials, that are trapped in geological formations in the earth's crust. A well is drilled into the ground and directed to the targeted geological location from a drilling rig at the earth's surface.

Once a formation of interest is reached, drillers often investigate the formation and its contents by taking samples of the formation rock and analyzing the rock samples. Typically, a sample is cored from the formation using a hollow coring bit, and the sample obtained using this method is generally referred to as a "core sample." Once the core sample has been transported to the surface, it may be analyzed to assess, among other things, the reservoir storage capacity (porosity) and the flow potential (permeability) of the material that makes up the formation; the chemical and mineral composition of the fluids and mineral deposits contained in the pores of the formation; and the irreducible water content of the formation material. The information obtained from analysis of a sample is used to design and implement well completion and production facilities.

"Conventional coring," or axial coring, involves taking a core sample from the bottom of the well. Typically, this is done after the drill string has been removed, or "tripped," from the wellbore, and a rotary coring bit with a hollow interior for receiving the core sample is lowered into the well on the end of a drill string. Some drill bits include a coring bit near the center of the drill bit, and a core sample may be taken without having to trip the drill string. A core sample obtained in conventional coring is taken along the path of the wellbore; that is, the core is taken along the axis of the borehole from the rock below the drill bit.

A typical axial core is 4-6 inches (about 10-15 cm) in diameter and can be over 100 feet (about 30 m) long. The rotary motion is typically generated at the surface, and the coring bit is driven into the formation by the weight of the drill string that extends back to the surface. The core sample is broken away from the formation by simply pulling upward on the coring bit that contains the sample.

By contrast, in "sidewall coring," a core sample is taken from the side wall of a drilled borehole. Sidewall coring is typically performed after the drill string has been removed from the borehole. A wireline coring tool that includes a coring bit is lowered into the borehole, and a small core sample is taken from the sidewall of the borehole. In sidewall coring, the drill string cannot be used to rotate the coring bit, nor can it provide the weight required to drive the bit into the formation. Instead, the coring tool must generate both the rotary motion of the coring bit and the axial force necessary to drive the coring bit into the formation.

In sidewall coring, the available space is limited by the diameter of the borehole. There must be enough space to withdraw and store a sample. Because of this, a typical sidewall core sample is about 1 inch (about 2.5 cm) in diameter and less than about 2 inches long (about 5 cm). The small size of the sample does not permit enough frictional forces between the coring bit and the core sample for the core sample to be removed by simply withdrawing the coring bit. Instead, the coring bit is typically tilted to cause the core sample to fracture and break away from the formation.

An additional problem that may be encountered is that because of the short length of a side wall core sample, it may be difficult to retain the core sample in the coring bit. Thus, a coring bit may also include mechanisms to retain a core sample in the coring bit even after the sample has been fractured or broken from the formation. Sidewall coring is beneficial in wells where the exact depth of the target zone is not well known. Well logging tools, including coring tools, can be lowered into the borehole to evaluate the formations through which the borehole passes. Multiple core samples may be taken at different depths in the borehole so that information may be gained about formations at different depths.

Previous designs, however, are either not suitable for unconsolidated formations or the lower part of the sediment core is disturbed and partly lost during sampling.

SUMMARY

Example embodiments relate to a core catcher and a core sampling method for micro-coring unconsolidated sediments from the earth. The example embodiments disclosed allow the sediment to stay relatively undisturbed when retrieving from the ground or borehole, and provide a bottom seal for preserving in-situ fluids. The unconsolidated sediment can be loose sand or soil in the vadose zone (with moisture) or any unconsolidated rock formation in the subsurface. The core catcher is made of membranes and metal wires on the periphery of the membranes. The metal wires facilitate cutting through sediments once the coring/sampling has been finished, and separate the sediments inside and outside of the corer. The membranes hold both the sediment and part of any fluids in the sampler. The core catcher can be switched from the open to the closed position in order to hold the cored material within the corer.

One example embodiment is a core sampler including an inner wall, an outer wall, a plurality of membranes disposed between the inner wall and outer wall, the plurality of membranes attached to the inner wall and outer wall at one or more attachment points, and a rotating knob attached to the inner wall or outer wall, the rotating knob configured to rotate the inner wall relative to the outer wall when the rotating knob is attached to the inner wall and to rotate the outer wall relative to the inner wall when the rotating knob is attached to the outer wall, wherein the membranes reside between the inner wall and the outer wall when the core sampler is fully open, and wherein the membranes come together and fully close the core sampler when the rotating knob is rotated 180 degrees or more. The perimeter of each of the membranes may be reinforced by a metal string or metal wire. A protective ring may be disposed on the outer wall in order to prevent sediments from entering the space between the inner wall and the outer wall prior to a coring operation. The plurality of membranes can be made from any material that is flexible, strong, porous, and durable, including but not limited to the group consisting of acetate cellulose, polycarbonate film, cellulose nitrate, plastics, and metal. In some embodiments, the core sampler may include three membranes that overlap each other when the core sampler is fully closed. Each membrane may be configured to cover half of the area of the lower end of the inner wall when the core sampler is fully closed. The thickness of the inner wall may be reduced near the lower end of the core sampler to accommodate the folded membranes.

Another example embodiment is a method for sampling a core. The method may include inserting a core sampler in a subsurface formation. The core sampler may include an inner wall, an outer wall, a plurality of membranes disposed between the inner wall and outer wall, the plurality of membranes attached to the inner wall and outer wall at one or more attachment points; and a rotating knob attached to the inner wall or outer wall, the rotating knob configured to rotate the inner wall relative to the outer wall when the rotating knob is attached to the inner wall and to rotate the outer wall relative to the inner wall when the rotating knob is attached to the outer wall. The method may also include rotating the knob 180 degrees, or more, to fully close the opening of the core sampler, thereby collecting a core sample in the inner wall of the core sampler. The membranes may reside between the inner wall and the outer wall when the core sampler is fully open. The method may further include reinforcing the perimeter of each of the membranes with a metal string or metal wire. The method may also include disposing a protective ring on the outer wall in order to prevent sediments from entering the space between the inner wall and the outer wall prior to the coring operation. The plurality of membranes can be made from any material that is flexible, strong, porous, and durable, including but not limited to the group consisting of acetate cellulose, polycarbonate film, cellulose nitrate, plastics, and metal. The method may further include providing three membranes that overlap each other when the core sampler is fully closed. The method may also include configuring each membrane to cover half of the area of the lower end of the inner wall when the core sampler is fully closed. The method may further include providing a reduced thickness of the inner wall near the lower end of the core sampler to accommodate the folded membranes.

Another example embodiment is a core catcher including an inner wall, an outer wall, a plurality of membranes disposed between the inner wall and outer wall, the plurality of membranes attached to the inner wall and outer wall at one or more attachment points, and a rotating knob attached to the inner wall or outer wall, the rotating knob configured to rotate the inner wall relative to the outer wall when the rotating knob is attached to the inner wall and to rotate the outer wall relative to the inner wall when the rotating knob is attached to the outer wall. The membranes may reside between the inner wall and the outer wall when the core sampler is fully open, and the membranes come together and fully close the core sampler when the rotating knob is rotated 180 degrees or more. The perimeter of each of the membranes may be reinforced by a metal string or metal wire. The plurality of membranes can be made from any material that is flexible, strong, porous, and durable, including but not limited to the group consisting of acetate cellulose, polycarbonate film, cellulose nitrate, plastics, and metal.

BRIEF DESCRIPTION OF THE DRAWINGS

So that the manner in which the features, advantages and objects of the example embodiments, as well as others which may become apparent, are attained and can be understood in more detail, more particular description of the example embodiments briefly summarized above may be had by reference to the embodiment which is illustrated in the appended drawings, which drawings form a part of this specification. It is to be noted, however, that the drawings illustrate only example embodiments and is therefore not to be considered limiting of its scope as the invention may admit to other equally effective embodiments.

DETAILED DESCRIPTION

The methods and systems of the present disclosure will now be described more fully with reference to the accompanying drawings in which embodiments are shown. The methods and systems of the present disclosure may be in many different forms and should not be construed as limited to the illustrated embodiments set forth in this disclosure; rather, these embodiments are provided so that this disclosure will be thorough and complete, and will fully convey its scope to those skilled in the art. Like numbers refer to like elements throughout.

Figure 1A:
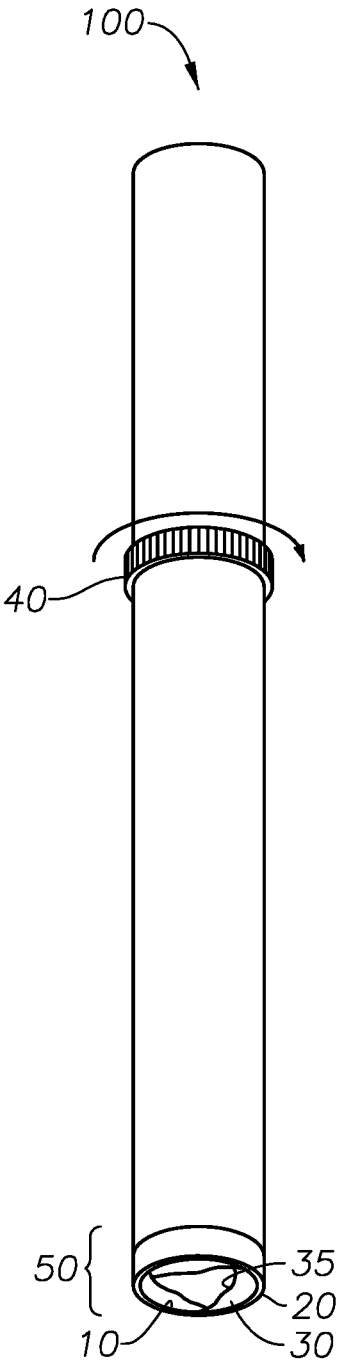
FIGS. 1A and 1B illustrate a core sampler including a core catcher, according to one or more example embodiments of the disclosure.

Turning now to the figures, FIG. 1A is an illustration of a core sampler 100 for sampling unconsolidated sediment, according to one or more example embodiments of the disclosure. The core sampler includes an inner wall 10, an outer wall 20, a rotating knob 40, and a core catcher 50 while it closes and catches the core. A plurality of membranes 30 are disposed between the inner wall 10 and outer wall 20. The plurality of membranes 30 are attached to the inner wall 10 and outer wall 20 at one or more attachment points, which will be described in further detail with reference to FIGS. 3A and 3B. A rotating knob 40 may be attached to the inner wall 10 may be configured to rotate the inner wall 10 relative to the outer wall 20 when the rotating knob 40 is attached to the inner wall 10. Alternatively, the rotating knob 40 may be attached to the outer wall 20 and may be configured to rotate the outer wall 20 relative to the inner wall 10. The membranes 30 reside between the inner wall 10 and the outer wall 20 when the core sampler 100 is fully open, and when the rotating knob 40 is turned in the anti-clockwise direction, the membranes 30 move closer together, and come together to fully close the core sampler as illustrated in FIG. 1B.

Figure 1B:
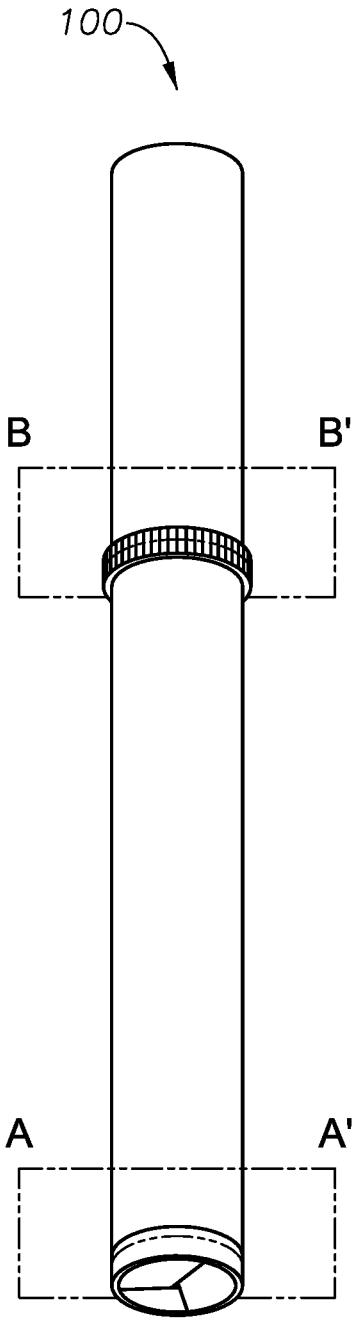
Figure 2A:
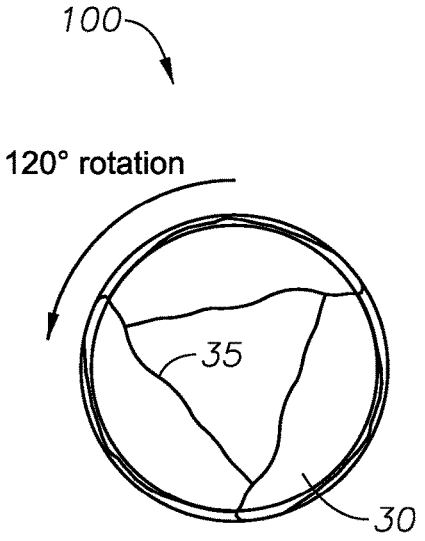
FIGS. 2A and 2B illustrate a bottom view of the core sampler shown in FIGS. 1A and 1B respectively, according to one or more example embodiments of the disclosure.
Figure 2B:
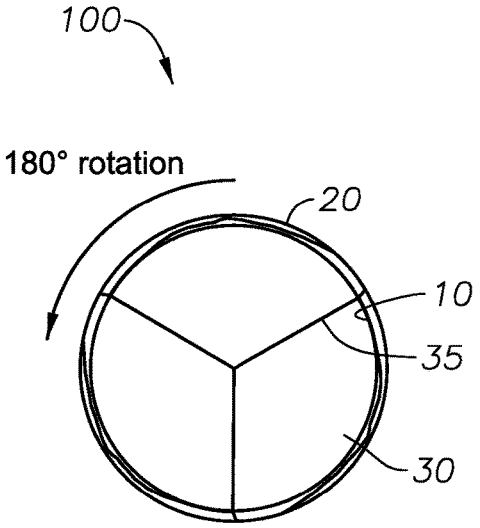

FIG. 2A illustrates a bottom view of the core sampler 100 shown in FIG. 1A. As seen here, when the rotating knob 40 is turned about 120 degrees in the anti-clockwise direction, for example, the membranes 30 start moving closer to each other and partially overlap each other. FIG. 2B illustrates a bottom view of the core sampler 100 shown in FIG. 1B. When the rotating knob 40 is turned about 180 degrees or more, the membranes 40 fully overlap each other, and each membrane 40 covers about half of the area of the lower end of the inner wall 10, as illustrated. Although only three membranes are illustrated in this figure, this is for illustration purposes only, and the disclosure is not limited to this configuration. For example, the core sampler 100 may include just two membranes 40 or four membranes 40 or even more.

As illustrated in FIGS. 2A and 2B, the perimeter of each of the membranes 30 may be reinforced by a metal string or metal wire 35 in order to cut through the loose sediment and secure the loose sediment sample and any fluids in the sampler. The plurality of membranes 30 may be made from any material that is flexible, strong, porous, and durable, including but not limited to the group consisting of acetate cellulose, polycarbonate film, cellulose nitrate, plastics, and metal, and can be single-use or reusable. In some embodiments, the core sampler 100 may include three membranes that overlap each other when the core sampler is fully closed, and each membrane may be configured to cover half of the area of the lower end of the inner wall when the core sampler is fully closed. The membranes may be folded and held in between the inner 10 and outer wall 20 when sampling, and may be expanded to cover the open lower end of the corer after sampling. The thickness of the inner wall 10 may be reduced near the lower end of the core sampler 100 to accommodate the folded membranes 40.

Figure 3A:
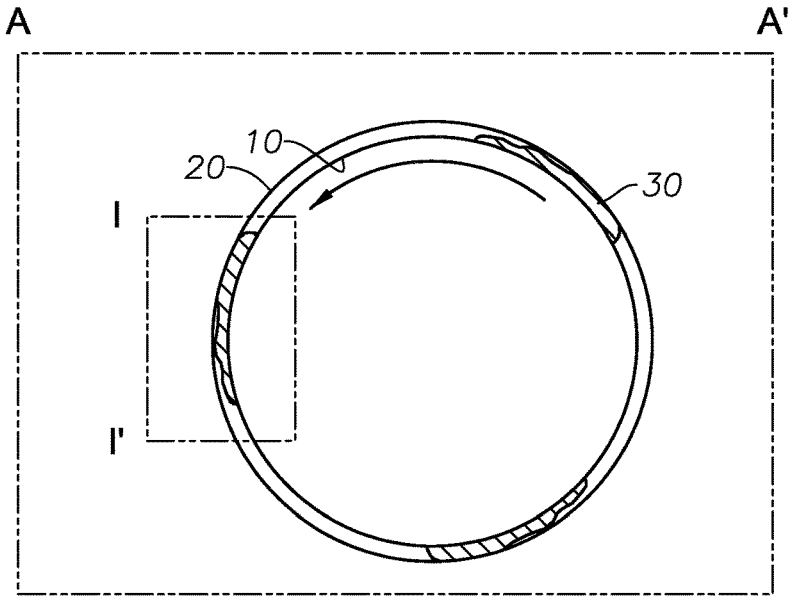
FIG. 3A illustrates a cross-sectional view of the core sampler shown in FIG. 1B along line A-A', according to one or more example embodiments of the disclosure.
Figure 3B:
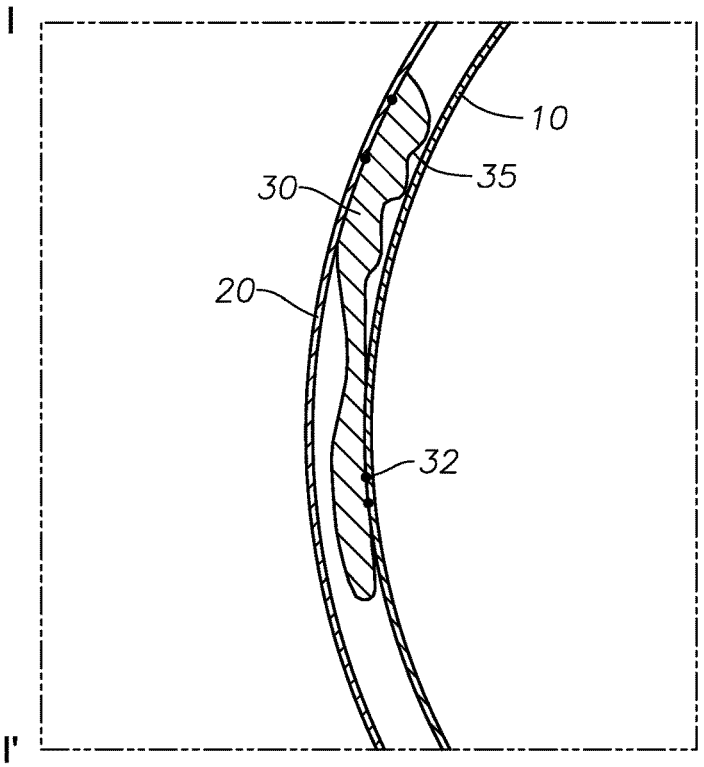
FIG. 3B illustrates a cross-sectional view of the core sampler shown in FIG. 3A along line I-I', according to one or more example embodiments of the disclosure.

FIG. 3A illustrates a cross-sectional view of the core sampler 100 along line A-A' shown in FIG. 1B. As it can be seen here, the membranes 30 reside between the inner wall 10 and outer wall 20 when the core sampler is fully open. FIG. 3B illustrates a further cross-sectional view of the sampler along line I-I' shown in FIG. 3A. Here each membrane 30 is attached to both the inner 10 and outer walls 20 at one or more fixing points 32, and a relative rotational movement between the inner 10 and outer wall 20 helps the membranes 30 to expand and cover part of the surface of the inner tube. The relative rotation of the inner to the outer walls may be done mechanically by rotating the knob 40. However, this is just an example, and the actuation may be performed using an electric, electro-mechanical, hydraulic or pneumatic means also.

Figure 4A:
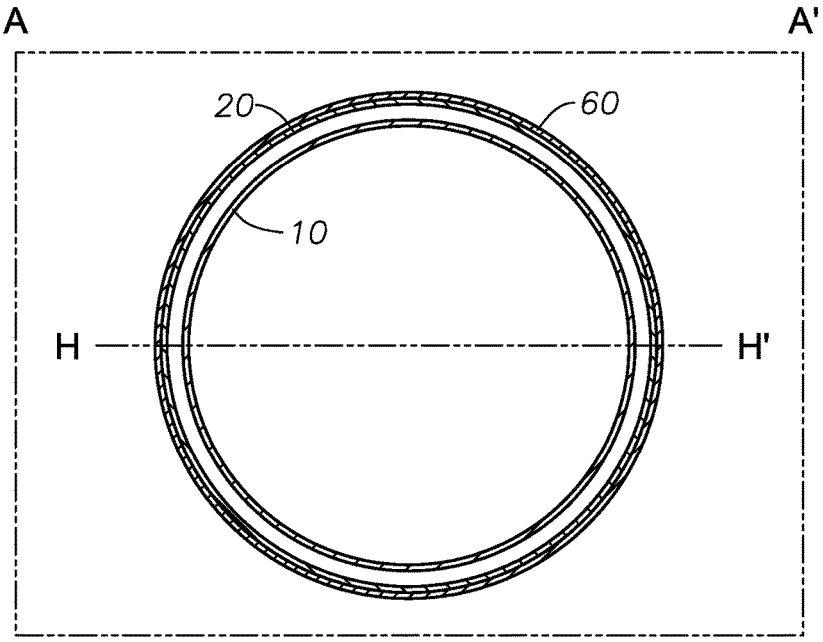
FIG. 4A illustrates a cross-sectional view of the core sampler shown in FIG. 1B along line A-A', according to one or more example embodiments of the disclosure.
Figure 4B:
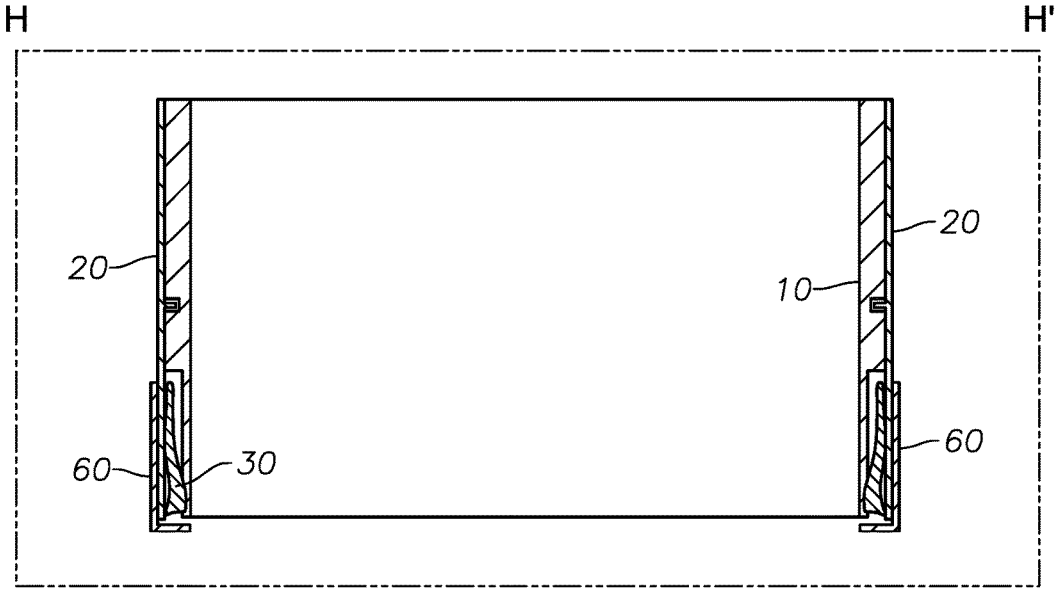
FIG. 4B illustrates a cross-sectional view of the core sampler shown in FIG. 4A along line H-H', according to one or more example embodiments of the disclosure.

FIG. 4A illustrates a cross-sectional view of the core sampler 100 along line A-A' shown in FIG. 1B. In this figure, it is shown that a protective ring 60 may be disposed on the outer wall 10 in order to allow sediment to enter the inner tube, and prevent sediments from entering the space between the inner wall 10 and the outer wall 20 prior to a coring or cutting operation. FIG. 4B illustrates a cross-sectional view of the core sampler 100 along line H-H' shown in FIG. 4A. As shown in this figure, protective ring 60 may be removable to facilitate the installation of the membranes 30.

Figure 5A:
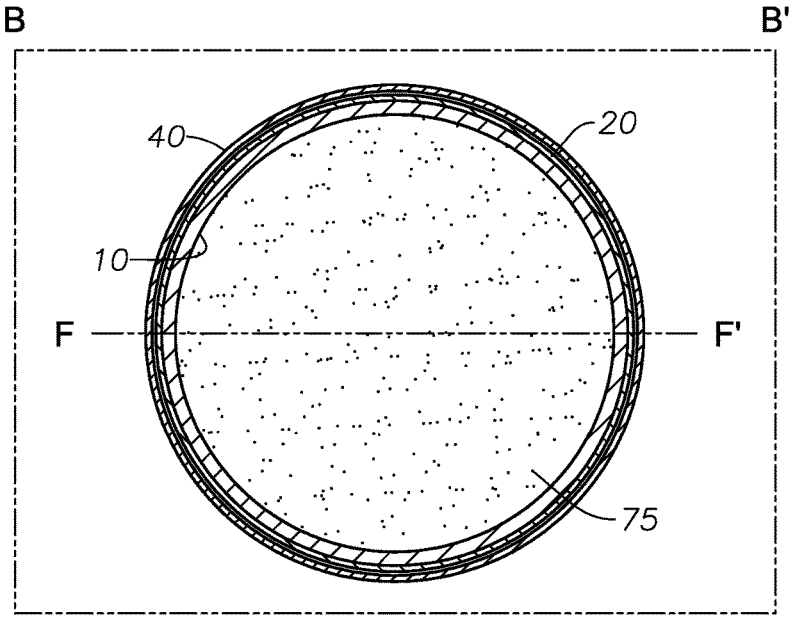
FIG. 5A illustrates a cross-sectional view of the core sampler shown in FIG. 1B along line B-B', according to one or more example embodiments of the disclosure.
Figure 5B:
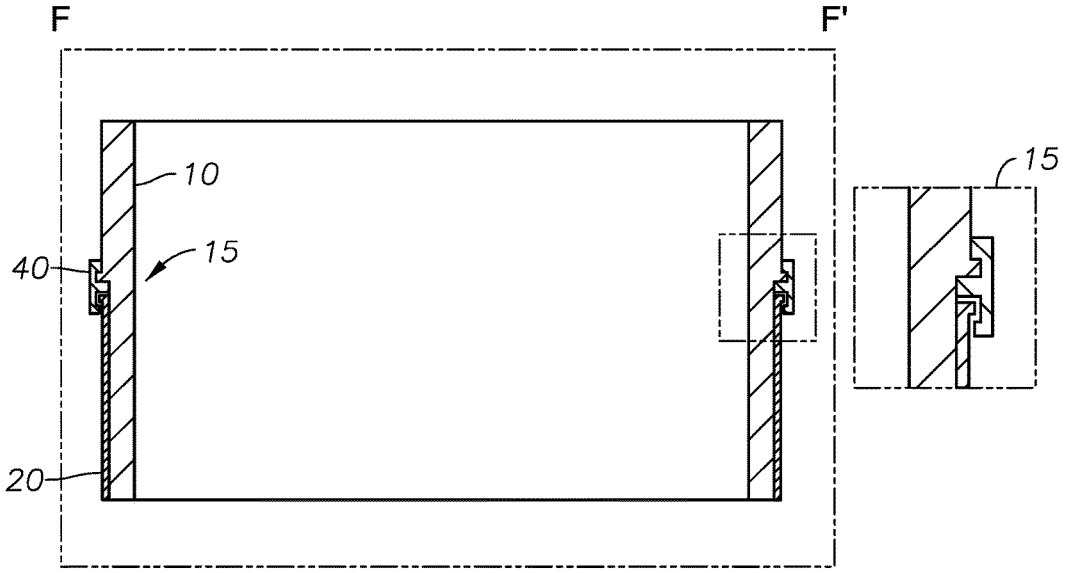
FIG. 5B illustrates a cross-sectional view of the core sampler shown in FIG. 5A along line F-F', according to one or more example embodiments of the disclosure.
Figure 5C:
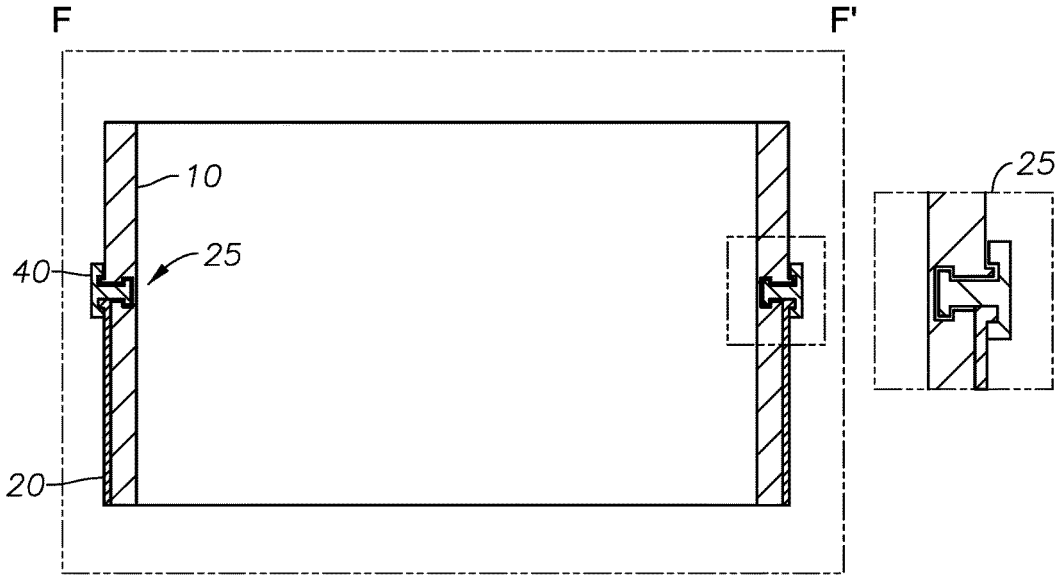
FIG. 5C illustrates a cross-sectional view of the core sampler shown in FIG. 5A along line F-F', according to one or more example embodiments of the disclosure.

FIG. 5A illustrates a cross-sectional view of the core sampler 100 along line B-B' shown in FIG. 1B. As seen in this figure, loose sediment 75 may be collected in the inner wall of the core sampler 100 by operation of the knob 40. FIG. 5B illustrates one example embodiment of the core sampler along line F-F' shown in FIG. 5A. In this example embodiment, the rotating knob 40 is attached to the inner wall 10 at a fixing point 15, for example, and turning the knob 40 rotates the inner wall 10 relative to the outer wall 20. FIG. 5C illustrates another example embodiment, where the rotating knob 40 is attached to the outer wall 20 at an alternate fixing point 25, and turning the knob 40 rotates the outer wall 20 relative to the inner wall 10. In both cases the fixed ends of the membranes 30 move relative to each other and gradually pull out the folded membranes until they reach their full extent when the knob 40 is turned 180 degree or more. Two fixing points may be provided to prevent the outer wall 20 from sliding and wobbling up or down in reference to the inner wall 10. The upper fixing point is the mechanical knob 40 shown in FIGS. 5B and 5C, and the lower fixing point is just above the space holding the membranes 30, as shown in FIG. 4B, for example.

Figure 6:
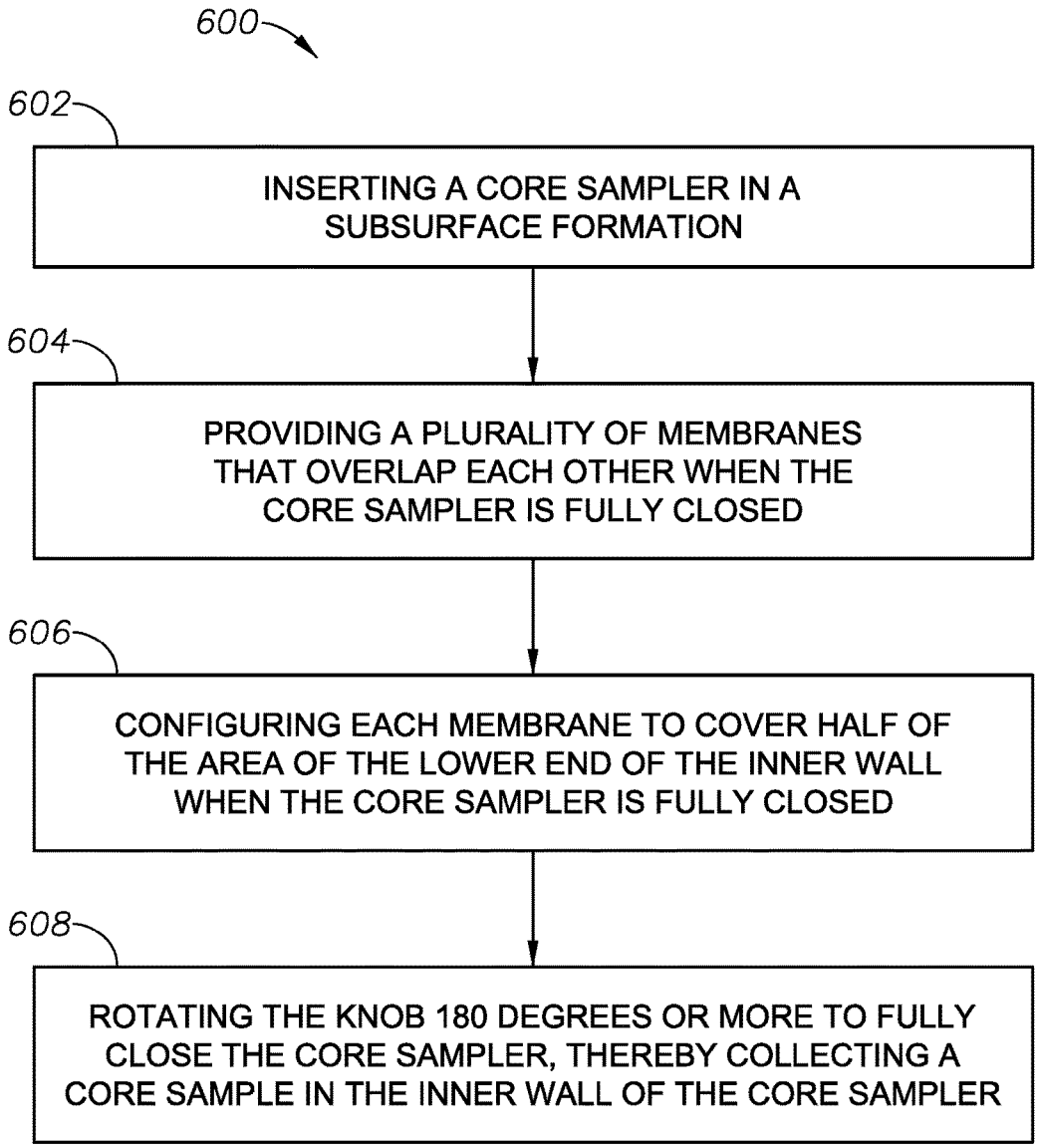
FIG. 6 illustrates example steps in a method for sampling a core using a core sampler, according to one or more example embodiments of the disclosure.

FIG. 6 illustrates example steps in a method 600 for sampling a core using a core sampler, according to one or more example embodiments of the disclosure. At step 602, the method may include inserting a core sampler, as shown in FIGS. 1A-5C for example, in a subsurface formation. As illustrated in these figures, the core sampler may include an inner wall, an outer wall, a plurality of membranes disposed between the inner wall and outer wall. The plurality of membranes may be attached to the inner wall and outer wall at one or more attachment points. The core sample may also include a rotating knob attached to the inner wall or outer wall. The rotating knob may be configured to rotate the inner wall relative to the outer wall when the rotating knob is attached to the inner wall and to rotate the outer wall relative to the inner wall when the rotating knob is attached to the outer wall. At step 604, the method may include providing three membranes that overlap each other when the core sampler is fully closed. At step 606, the method may include configuring each membrane to cover half of the area of the lower end of the inner wall when the core sampler is fully closed. At step 608, the method may include rotating the knob 180 degrees or more to fully close the core sampler, thereby collecting a core sample in the inner wall of the core sampler. The membranes may reside between the inner wall and the outer wall when the core sampler is fully open. The method may further include reinforcing the perimeter of each of the membranes with a metal string or metal wire. The method may also include disposing a protective ring on the outer wall in order to prevent sediments from entering the space between the inner wall and the outer wall prior to the coring operation. The plurality of membranes may be made from any material that is flexible, strong, porous, and durable, including but not limited to the group consisting of acetate cellulose, polycarbonate film, cellulose nitrate, plastics, and metal. The method may optionally include providing a reduced thickness of the inner wall near the lower end of the core sampler to accommodate the folded membranes.

Another example embodiment is a core catcher including an inner wall, an outer wall, a plurality of membranes disposed between the inner wall and outer wall. The plurality of membranes may be attached to the inner wall and outer wall at one or more attachment points, and a rotating knob may be attached to the inner wall or outer wall. The rotating knob may be configured to rotate the inner wall relative to the outer wall when the rotating knob is attached to the inner wall and to rotate the outer wall relative to the inner wall when the rotating knob is attached to the outer wall. The membranes may reside between the inner wall and the outer wall when the core sampler is fully open, and the membranes come together and fully close the core sampler when the rotating knob is rotated 180 degrees or more. The perimeter of each of the membranes may be reinforced by a metal string or metal wire. The plurality of membranes can be made from any material that is flexible, strong, porous, and durable, including but not limited to the group consisting of acetate cellulose, polycarbonate film, cellulose nitrate, plastics, and metal, for example.

The Specification, which includes the Summary, Brief Description of the Drawings and the Detailed Description, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced.

Conditional language, such as, among others, "can," "could," "might," or "may," unless specifically stated otherwise, or otherwise understood within the context as used, is generally intended to convey that certain implementations could include, while other implementations do not include, certain features, elements or operations. Thus, such conditional language generally is not intended to imply that features, elements or operations are in any way required for one or more implementations or that one or more implementations necessarily include logic for deciding, with or without user input or prompting, whether these features, elements or operations are included or are to be performed in any particular implementation.

The systems and methods described, therefore, are well adapted to carry out the objects and attain the ends and advantages mentioned, as well as others that may be inherent. While example embodiments of the system and method has been given for purposes of disclosure, numerous changes exist in the details of procedures for accomplishing the desired results. These and other similar modifications may readily suggest themselves to those skilled in the art, and are intended to be encompassed within the spirit of the system and method disclosed and the scope of the appended claims.

The invention claimed is:

1. A core sampler comprising:

an inner wall;

an outer wall;

a plurality of membranes disposed between the inner wall and outer wall, the plurality of membranes attached to the inner wall and outer wall at one or more attachment points; and a rotating knob attached to the inner wall or outer wall, the rotating knob configured to rotate the inner wall relative to the outer wall when the rotating knob is attached to the inner wall and to rotate the outer wall relative to the inner wall when the rotating knob is attached to the outer wall, wherein the membranes reside between the inner wall and the outer wall when the core sampler is fully open, and wherein the membranes come together and fully close the core sampler when the rotating knob is rotated 180 degrees or more.

2. The core sampler of claim 1, wherein the perimeter of each of the membranes is reinforced by a metal string or metal wire.

3. The core sampler of claim 1, further comprising:

a protective ring disposed on the outer wall in order to prevent sediments from entering the space between the inner wall and the outer wall prior to a coring operation.

4. The core sampler of claim 1, wherein the plurality of membranes are made from a material selected from the group consisting of acetate cellulose, polycarbonate film, cellulose nitrate, plastics, and metal.

5. The core sampler of claim 1, comprising three membranes that overlap each other when the core sampler is fully closed.

6. The core sampler of claim 5, wherein each membrane is configured to cover half of the area of the lower end of the inner wall when the core sampler is fully closed.

7. The core sampler of claim 1, wherein the thickness of the inner wall is reduced near the lower end of the core sampler to accommodate the folded membranes.

8. A method for sampling a core, the method comprising:

inserting a core sampler in a subsurface formation, the core sampler comprising:

an inner wall;

an outer wall;

a plurality of membranes disposed between the inner wall and outer wall, the plurality of membranes attached to the inner wall and outer wall at one or more attachment points; and a rotating knob attached to the inner wall or outer wall, the rotating knob configured to rotate the inner wall relative to the outer wall when the rotating knob is attached to the inner wall and to rotate the outer wall relative to the inner wall when the rotating knob is attached to the outer wall;

rotating the knob 180 degrees or more to fully close the core sampler, thereby collecting a core sample in the inner wall of the core sampler.

9. The method of claim 8, wherein the membranes reside between the inner wall and the outer wall when the core sampler is fully open.

10. The method of claim 8, further comprising:

reinforcing the perimeter of each of the membranes with a metal string or metal wire.

11. The method of claim 8, further comprising:

disposing a protective ring on the outer wall in order to prevent sediments from entering the space between the inner wall and the outer wall prior to the coring operation.

12. The method of claim 8, wherein the plurality of membranes are made from a material selected from the group consisting of acetate cellulose, polycarbonate film, cellulose nitrate, plastics, and metal.

13. The method of claim 8, further comprising:

providing three membranes that overlap each other when the core sampler is fully closed.

14. The method of claim 13, further comprising:

configuring each membrane to cover half of the area of the lower end of the inner wall when the core sampler is fully closed.

15. The core sampler of claim 8, further comprising:

providing a reduced thickness of the inner wall near the lower end of the core sampler to accommodate the folded membranes.

16. A core catcher comprising:

an inner wall;

an outer wall;

a plurality of membranes disposed between the inner wall and outer wall, the plurality of membranes attached to the inner wall and outer wall at one or more attachment points; and a rotating knob attached to the inner wall or outer wall, the rotating knob configured to rotate the inner wall relative to the outer wall when the rotating knob is attached to the inner wall and to rotate the outer wall relative to the inner wall when the rotating knob is attached to the outer wall.

17. The core catcher of claim 16, wherein the membranes reside between the inner wall and the outer wall when the core sampler is fully open.

18. The core catcher of claim 16, wherein the membranes come together and fully close the core sampler when the rotating knob is rotated 180 degrees or more.

19. The core catcher of claim 16, wherein the perimeter of each of the membranes is reinforced by a metal string or metal wire.

20. The core catcher of claim 16, wherein the plurality of membranes are made from a material selected from the group consisting of acetate cellulose, polycarbonate film, cellulose nitrate, plastics, and metal.

* * * * *